United States Patent [19]

Scribner

[11] 4,351,462

[45] Sep. 28, 1982

[54] PNEUMATIC FEEDER FOR PUNCH PRESSES AND THE LIKE

[76] Inventor: Albert W. Scribner, 6 Country Club Rd., Darien, Conn. 06820

[21] Appl. No.: 223,786

[22] Filed: Jan. 9, 1981

[51] Int. Cl.[3] ..... B65H 17/36; B65H 17/44

[52] U.S. Cl. ..... 226/150; 226/158

[58] Field of Search ..... 226/149, 150, 162, 115, 226/101; 83/225, 250, 277

[56] References Cited

U.S. PATENT DOCUMENTS

| | | | |
|---|---|---|---|
| 3,038,645 | 6/1962 | Nordloff | 226/149 |
| 3,329,327 | 7/1967 | Scribner | 226/150 |
| 3,561,657 | 2/1971 | Scribner | 226/150 |
| 4,051,987 | 10/1977 | Scribner | 226/115 |
| 4,223,821 | 9/1980 | McCall | 226/101 |
| 4,261,238 | 4/1981 | Scribner | 83/225 |

*Primary Examiner*—Leonard D. Christian

[57] ABSTRACT

A novel arrangement for the air circuit conduit lines of a pneumatically operated feeder for punch presses and the like. In order to insure that the stock gripping action of the feeder occurs before the initiation of the feed motion of the feed slide of the feeder a physically circuitous or roundabout path is provided for the air flowing between the control valve and the head end of the main feed cylinder. In this arrangement the main cylinder is located in the control circuit so as to be effectively disposed downstream of the stock grip cylinders when pressure air is directed to the main cylinder and so as to be effectively disposed upstream of said grip cylinders when pressure air is exhausted from said main cylinder. This arrangement will facilitate the establishment of the short but necessary time delay needed to enable the completion of the stock grip and release actions before movement of the feed slide commences.

1 Claim, 4 Drawing Figures

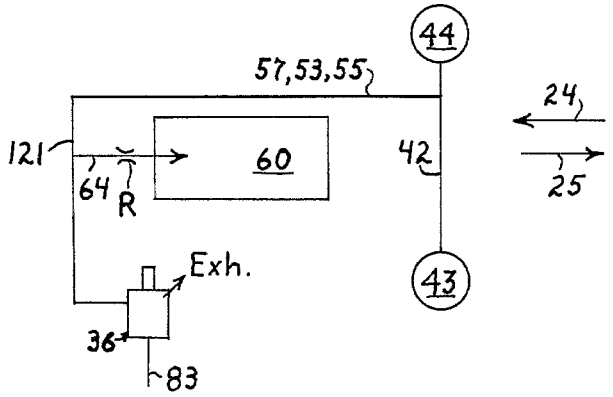
Fig. 1
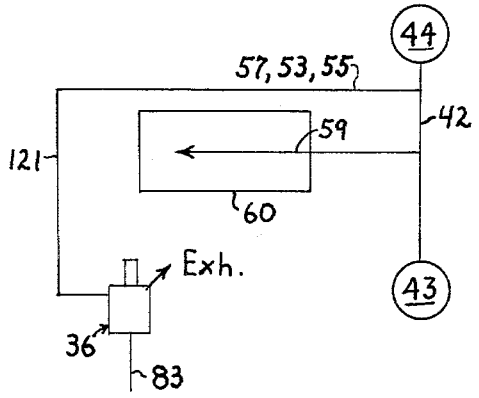
Fig. 2
Fig. 3
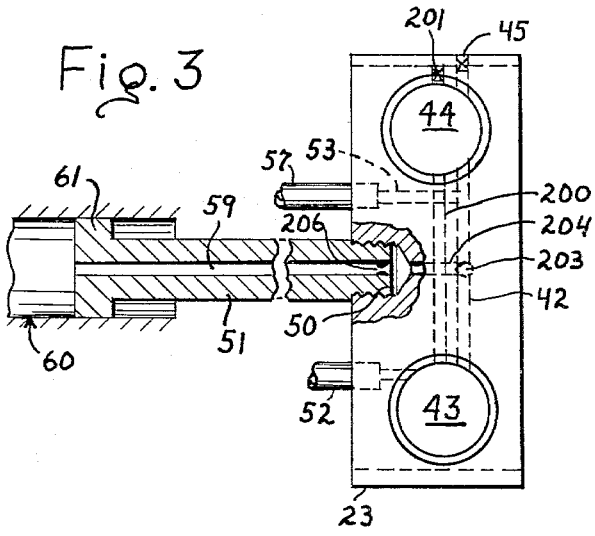
Fig. 4
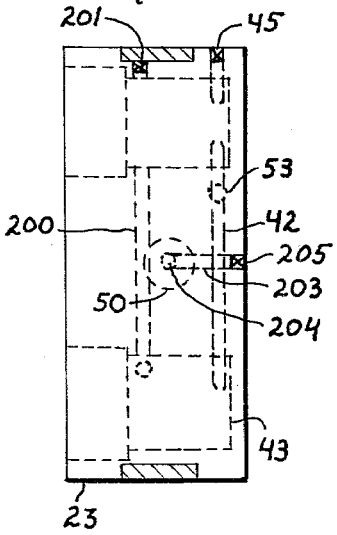

PNEUMATIC FEEDER FOR PUNCH PRESSES AND THE LIKE

BACKGROUND OF THE INVENTION

Stock feeding devices of the type disclosed in my U.S. Pat. No. 3,329,327 have been in commercial use for several years and have performed feeding operations in an expeditious manner. There are however some instances where misfeeds can occur in the use of such feeders if there is any improper sequencing of the stock gripping and feed actions, this being caused, among other possible reasons, by the applying and exhausting of pressure air to and from the main cylinder too early with respect to the applying and exhausting of pressure air to and from the stock grip cylinders. Without a slight time delay between the operation of the stock grip cylinders and the main cylinder the feed slide may commence movement in a feed direction before the stock is fully gripped and if this occurs the increment of stock fed during a feed cycle will be shorter than that for which the feeder is set.

SUMMARY OF THE INVENTION

In order to facilitate and promote the establishment of the above noted required time delay the physical layout of the pneumatic control circuit for the said type of feeder is changed so that the air flow path from the control valve means to the main cylinder is circuitous or roundabout so that pressure air will reach and actutate the stock grip cylinders before the main feed cylinder is operated and conversely pressure air will exhaust from said grip cylinder before said main cylinder starts to move the feed slide. This time delay will promote the feeding accuracy of the unit.

BRIEF DESCRIPTION OF THE DRAWINGS

FIG. 1 is a schematic sketch of the pneumatic circuit of a feeder of the type illustrated in my U.S. Pat. No. 3,329,327.

FIG. 2 is a schematic sketch illustrating a modified physical layout in accordance with the present invention.

FIG. 3 is a plan view of the feeder which embodies the circuit layout shown in FIG. 2.

FIG. 4 is a right side elevation view of portions of the structure illustrated in FIG. 3.

DETAILED DESCRIPTION OF THE INVENTION

The disclosure in my prior U.S. Pat. No. 3,329,327 is incorporated herein by reference and except as otherwise indicated the same references numerals are used herein as are used for the corresponding parts of the apparatus described in said patent. Only those structural portions of the feeder which are pertinent to the present invention are shown and described herein.

Referring to FIG. 1 there is shown a schematic layout of the control air flow paths between the control valve means 36 and both the head (left) end of the main cylinder 60 and lower control portions of the grip cylinders 43,44. In commercial versions of the type of feeder shown in my said United States Patent a variable air flow restriction, illustrated at R in FIG. 1 has been provided in air line 64 so as to enable the speed of the feed head or slide to be varied. As may be seen from FIG. 1 when pressure air is directed by the valve means 36 to said main and grip cylinders the head end of the main cylinder 60 is effectively disposed generally upstream of said grip cylinders 43,44 and thus such pressure air may have a tendency to reach the head end of the main cylinder before it reaches the grip cylinders 43, 44 and if this occurs the feed slide may improperly commence an index movement before the stock is fully released. This condition may occur for example when the speed control restriction R in the line 64 is opened to a significant extent as is the case when higher feeder speeds are called for. A corresponding condition may exist when pressure air is exhausted from said cylinders through the valve means 36, the main cylinder in this case being effectively downstream from the grip cylinders so that the feed slide may improperly commence a feed movement before the stock is firmly gripped. If either or both of the two above noted undesireable conditions occur the accuracy of the feeder will deteriorate; the consistency and integrity of the set feed increment being dependent upon the stock being firmly gripped or released before any movement of the feed slide commences in either the feed or index directions 24 and 25 respectively.

In order to promote at all times a short time delay between the stock grip and feed actions of the feeder the present invention contemplates the provision of an improved physical arrangement for the air flow lines of the feeder, which arrangement includes a circuitous or roundabout path for the air flow to and from the head end of the main cylinder. This improved air conduit arrangement is illustrated in FIG. 2 whereby line 64 of FIG. 1 is eliminated and the air conduit to the head end of the main cylinder 60 extends from the valve means 36 through the main body of the feeder and out to the slide through air lines 121, 55, 57 and 53, then through line 42 in the feed slide and then back through a line or passageway 59 formed longitudinally through the main piston and piston rod of the feeder. As may be seen from FIG. 2 the head end of the main cylinder 60 will now effectively be generally downstream of the grip cylinders 43, 44 when pressure air is supplied thereto from said valve means, and will be generally upstream thereof when air is exhausted therefrom by said valve means whereby at the start of each index and feed stroke the said desired time delay sequencing is now promoted rather than being suppressed as in the cases discussed immediately above in connection with FIG. 1. More specifically here when pressure air is directed to said cylinders 60, 43 and 44 it will tend to reach the grip cylinders 43, 44 first and hence the grip cylinders will operated before operation of cylinder 60 commences thus insuring release of stock before any index movement of the feed slide commences. Conversely when pressure air is exhausted from said cylinders 60, 43, 44 the grip cylinders 43, 44 will tend to exhaust before cylinder 60 thus insuring gripping of the stock before any feed movement of the feed slide commences.

The structural modifications to the feeder necessary to embody the air conduit line arrangement of FIG. 2 is illustrated in FIGS. 3 and 4. Here the upper portions of the double acting cylinders 43, 44 are pneumatically interconnected by an air line 200 formed in feed slide 23, the outer end of said line being plugged as at 201. The line 42 interconnecting the lower portions of the grip cylinders 43, 44 communicates with a vertical air line 203 which in turn communicates with the inner end of the threaded bore 50 formed in the feed slide 23 through a horizontal air line 204, the lower end of the line 203 being plugged as at 205, and the outer end of the main piston rod 51 being threadedly coupled to said feed slide at said bore. The main piston rod 51 and piston 61 are formed with a longitudinal air conduit line or passageway 59 the left hand end of which, as seen in FIG. 3, opens into the head end of the main cylinder 60 while the right hand end thereof communicates with the inner end of said bore 50. If desired any suitable air flow restriction 206 may be provided in the passageway 59 for speed control purposes.

By means of the above described modifications in the main body, feed slide, piston and piston rod the present improved feeder will embody a circuit line arrangement corresponding to that described and illustrated in connection with FIG. 2, thereby facilitating the establishment of the above noted time delay needed for promoting the proper sequencing of the grip and feed actions of the feeder.

What is claimed is:

1. In a pneumatically operated feeder for intermittently advancing stock into the work station of a punch press or the like and having a main body;

rail means extending from said body;

a feed slide mounted on said rail means for reciprocating movement in feed and index directions;

stock gripping means carried by said feed slide and being adapted to be moved between stock gripping and stock release conditions;

abutment means carried at the outer end of said rail means for adjustably limiting the extent of movement of said feed slide in said index direction;

a first main fluid motor means disposed in said main body, said main fluid motor means including a piston and piston rod, the latter being connected at its outer end to said feed slide whereby said main fluid motor means is capable of reciprocally actuating said feed slide in said feed and index directions;

a second fluid motor means carried by said feed slide and adapted to move said stock gripping means between said stock gripping and stock release conditions; and valve means carried by said main body and adapted to control the operation of said first and second fluid motor means: the improvement conprising an improved fluid conduit line arrangement disposed between said valve means and said first and second fluid motor means whereby operation of said valve means causes said feed slide to move through alternate operative feed and index strokes;

said improved conduit line arrangement including a first air conduit line extending from the output of said valve means and through said main body;

a straight rigid tube coupled at one end thereof to said feed slide, the other end thereof being telescopically received by said main body and pneumatically communicating with said first conduit line;

a second air conduit line formed in said feed slide and pneumatically communicating with said second fluid motor means and with said one end of said tube; and a third air conduit line communicating with said second conduit line in said feed slide and with the head end of said main fluid motor means in said main body and including a longitudinal passageway formed through said piston and piston rod of said first fluid motor means;

said conduit line arrangement thus providing a roundabout circuitous path of flow for the air conducted between said valve means and said head end of said main fluid motor means in said main body, which path requires such air to flow serially through said main body, rigid tube, feed slide, piston rod and piston which in turn promotes in said feeder a short time delay between the respective initiations of operation of said second fluid motor means and said first fluid motor means.

* * * * *